United States Patent [19]

Diaz

[11] Patent Number: 5,070,340

[45] Date of Patent: Dec. 3, 1991

[54] BROADBAND MICROSTRIP-FED ANTENNA

[75] Inventor: Leopoldo J. Diaz, Golden, Colo.

[73] Assignee: Ball Corporation, Muncie, Ind.

[21] Appl. No.: 376,299

[22] Filed: Jul. 6, 1989

[51] Int. Cl.[5] ..... H01Q 13/08

[52] U.S. Cl. ..... 343/767; 343/772; 343/846

[58] Field of Search ..... 343/700 MS, 795, 767, 343/768, 829, 846, 772, 786

[56] References Cited

U.S. PATENT DOCUMENTS

| | | | |
|---|---|---|---|
| 3,836,976 | 9/1974 | Monser et al. | 343/795 |
| 4,500,887 | 2/1985 | Nester | 343/795 |
| 4,513,292 | 4/1985 | Bowman | 343/795 |
| 4,843,403 | 6/1989 | Lalezari et al. | 343/700 MS |
| 4,853,704 | 8/1989 | Diaz et al. | 343/770 |

FOREIGN PATENT DOCUMENTS

| | | | |
|---|---|---|---|
| 257881 | 3/1988 | European Pat. Off. . | |
| 3215323 | 7/1983 | Fed. Rep. of Germany | 343/768 |

OTHER PUBLICATIONS

Prasad, S. N. and Mahapatra, S., A Novel MIC Slot--Line Antenna, Proceed. of Europ. Microwave Conf., Brighton, England (Sep. 17-20, 1979).

Yngvesson et al., Endfire Tapered Slot Antennas On Dielectric Substrates (IEEE Trans. on Antennas and Propagation, vol. AP-33, No. 12, Dec. 1985).

*Primary Examiner*—Michael C. Wimer

*Attorney, Agent, or Firm*—Sheridan, Ross & McIntosh

[57] ABSTRACT

A broadband antenna capable of transmitting or receiving radio frequency signals. The antenna includes a substrate having a surface upon which a microstrip feed element is positioned orthogonal to the substrate, and a portion of the antenna element is positioned on and in direct contact with a portion of the microstrip feed element for transmitting or receiving signals therebetween. A ground plane is disposed on a surface of the substrate which is in opposing relation to and spaced from the microstrip feed element. Additionally, the antenna element includes a tapered notch of a "Vivaldi" configuration which facilitates endfire operation and reduces beamwidth.

13 Claims, 1 Drawing Sheet

BROADBAND MICROSTRIP-FED ANTENNA

FIELD OF THE INVENTION

The present invention relates to an easily-constructed antenna structure, and, more particularly, to a light-weight, microstrip-fed, endfire traveling-wave antenna which is capable of transmitting and/or receiving relatively narrow beams and yields broadband performance. The antenna structure, which achieves its intended purposes without use of plated-through holes or coaxial line transitions to feed the antenna, can be advantageously employed in free space with satellites and the like, and is well suited for use in array antennas.

BACKGROUND OF THE INVENTION

Interest in integrated antennas on dielectric surfaces continues to grow as knowledge of construction techniques advances in the fields of microwaves and millimeter waves. This interest is particularly acute in applications demanding light-weight, low-cost antennas of simple construction with broadband capacity and narrow beamwidth. Examples of such applications include satellite communication antennas, remote sensing antennas, and radio telescopes for radio astronomy.

Implementations involving broadside radiating elements, such as dipoles, microstrip patches and slots are generally unsuitable for the above-mentioned applications in which gain of 10 dB and beamwidths of 12°–60° are typically required. That is, in free-space applications with satellites and the like, it is often desirable to employ antennas which can produce a symmetric endfire beam with appreciable gain and low side lobes. Endfire traveling-wave antennas, having moderately high directivity (10–17 dB) for a given cross section, are well suited for the above-noted free space applications.

One known example of an endfire traveling wave antenna is the flared slot-line antenna. A complete discussion of the flared slot-line antenna can be found in Prasad, S. and Mahapatra, S. *A Novel MIC Slot-Line Antenna,* Proceed. of Europ. Microwave Conf., Brighton, England (17–20 Sept. 1979). As disclosed by Prasad et al., the operation of a slot-line antenna is based on the fact that a slot-line begins to radiate as the slot is widened (i.e. flared). In one arrangement of a flared slot-line antenna, metallization is provided on a single side of a dielectric substrate to form a flared slot, and a microstrip feed-line is disposed along an opposing surface of the substrate to define a coaxial line transition from the feed line to the notch antenna slot line.

In another arrangement of the slot-line antenna, a blade antenna element, having metallization provided on a single side of a first dielectric substrate to form a flared slot, is positioned orthogonally to a ground plane which is underlaid by a second dielectric substrate. A microstrip feed-line is disposed on an opposing surface of the second dielectric to define a coaxial line transition.

Typically slot-line antennas, such as the two arrangements described above, include an open circuit between the antenna element and feed line such that impedance matching of the antenna element to the feed line is required. The open circuit places a limitation on the ratio of high to low frequencies that the slotline antenna device can properly receive or transmit. Moreover, improper impedance matching can generate discontinuities which limit the bandwidth of an antenna structure.

Monser et al. U.S. Pat. No. 3,836,976 discloses a dipole array of slot antennas, each of which has a narrow slot region and a wide slot region with the transition being made in a single step. More specifically, first and second conductors of a coaxial feed line are soldered to first and second metallization layers disposed on a substrate, respectively. Such metallizations are disposed in an opposing, spaced manner to define a slot therebetween on each antenna element. Consequently, a potential can be developed between the first and second metallizations to achieve transmission from the slot. In the preferred embodiment of the Monser et al. dipole array, pairs of orthogonal antenna elements are arranged such that each of the antenna elements are short circuited by a common, orthogonal ground plane, and pairs of coaxial feed lines are specifically positioned to define phase centers on the dipole array pairs. It should be appreciated that the components of the Monser et al. dipole array are arranged to allow for transmission in one of a variety of polarizations. While Monser et al. note that the feed lines could be of microstrip construction and that the slots could be flared from a narrow portion to a wide portion in other than one step, there is no teaching as to how a design incorporating such features could be conveniently or operatively achieved.

Nester, U.S. Pat. No. 4,500,887 discloses a notch antenna element, including a planar substrate having topside and bottomside metallizations, as well as a microstrip transmission line connected to one end of the antenna element. The metallizations define, in overlapping relationship, a two-sided slot line and a symmetrical two-sided notch antenna. Edges of the metallizations are shaped according to a function to facilitate smooth transition from the connection of the microstrip feed line to the symmetrical two-sided flared notch antenna.

In applications requiring radiation of energy over a relatively long distance, such as satellite applications, it is desirable to confine the radiated energy into a small area, i.e. to limit beamwidth, so that radiated energy can be minimized. That is, with most antenna arrangements, less power is required to achieve suitable signal level at a remote receiver if beamwidth is reduced. It has been found that symmetric endfire beams with appreciable gain and low sidelobes can be achieved in flared notch antennas by use of a "Vivaldi" configuration of a metallization on a dielectric substrate of suitable thickness. The characteristics of the Vivaldi type radiator are discussed in considerable detail in Yngvesson et al., *Endfire Tapered Slot Antennas on Dielectric Substrates* (IEEE Trans. on Antennas and Propagation, v. AP-33, No. 12, Dec. 1985). As indicated in the Yngvesson article, with proper configuration of the Vivaldi radiator and adjustment of the planar dielectric substrate thickness, beamwidth is frequency-independent over a considerable range of frequencies.

While the above-noted background reflects advances in the field of slot-line antennas, there is a need in the field of long-distance communication, such as satellite applications, for an easily fed, flared-notch antenna that is both simply and compactly constructed, and that substantially alleviates impedance matching concerns associated with feed components. More specifically, a need exists for a slot-line or flared notch antenna which achieves these desirable characteristics, while providing broadband performance capability and relatively narrow beamwidths. Additionally, the antenna should be lightweight as well as easy to both manufacture and install.

SUMMARY OF THE INVENTION

The present invention is directed to a broadband, microstrip-fed antenna, including antenna means and a first substrate having a first surface upon which a microstrip conducting means is disposed. The antenna means is positioned on and orthogonal to the first substrate, i.e., the antenna means is orthogonal to its support structure. Moreover, the antenna means is positioned relative to the microstrip conducting means for direct signal transmission therebetween. By way of example, in the preferred embodiment, a portion of the antenna means directly contacts and overlaps a portion of the microstrip conducting means.

In one aspect of the invention, the antenna means includes a second substrate having a surface upon which a metallization is disposed. As indicated, a portion of the metallization is generally in direct contact with a portion of the microstrip conducting means. Ground means is disposed on a second surface of the first substrate in an opposing relation to and spaced from the first surface of the first substrate.

In one application of the present invention, the broadband, microstrip-fed antenna is provided with endfire capability for use in satellite communications. This is preferably accomplished by providing the antenna means with a flared notch, resembling a bisected Vivaldi radiator, and configuring the corresponding second substrate so that it is relatively thin. More specifically, an edge of the metallization is tapered according to an exponential function and cooperates with the first surface of the first substrate to define a radiator. It should be appreciated that a printed circuit card ("PC card") can readily serve to define a relatively thin antenna means.

Numerous advantages of the present invention will be appreciated by those skilled in the art.

A principal advantage of the present invention is that it has few parts and is simply designed and constructed. Thus, it is easy to manufacture, resulting in cost minimization.

Another advantage of the present invention is that it is compact, sturdy and lightweight. For example, the antenna means can be advantageously fabricated from PC cards, and such PC cards can be easily and reliably mounted on a substrate/microstrip arrangement. As such, the disclosed invention is particularly well-suited for satellite applications in which size and weight is preferably minimized, and mechanical integrity is maximized.

Another advantage of the present invention is that the structural and operative relationship between the antenna means and the microstrip conducting means avoids the transition present in conventional arrangements requiring coaxial feeds to excite antenna elements through a ground plate, and thus maximizes broadband operation.

Another advantage of the present invention is that, through use of the disclosed arrangement of a ground plane, notch means and microstrip conducting means, a highly efficient wave-guiding structure is realized. That is, in the preferred embodiment, the ground plane is a continuous planar sheet of conductive material which substantially underlies both of the notch means and the microstrip conducting means. Further, in the preferred embodiment, the antenna means and the microstrip conducting means are positioned along a common axis. Consequently, broadband operation is not degraded by "twisting", "bending" of or any other transmission discontinuities effecting the E-field. In particular, the disclosed invention is capable of operating within a frequency range of 2–18 GHz while achieving a voltage standing wave ratio (VSWR) of about 2:1.

Another advantage of the present invention is that optimal endfire operation is achieved as a result of the construction of the antenna means. That is, by using a notch having an exponential taper, i.e., a Vivaldi configuration, in conjunction with the relatively thin second substrate, narrow beamwidth is maintained at a constant level over a large range of frequency response. In the preferred embodiment, the beamwidth can be as narrow as 40½° in the E-plane and 11½° in the H-plane. Hence, the antenna is adapted to reliably and accurately transmit and receive electromagnetic waves over relatively long distances while optimizing energy usage.

A still further advantage of the present invention is that a plurality of the disclosed broadband microstrip-fed antennas can be readily configured in an array arrangement.

It is yet another advantage that the E field transmitted from and received at the antenna means is orthogonal to the antenna support structure. Such a relationship between the antenna means and its support structure yields cost, space and operational advantages.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
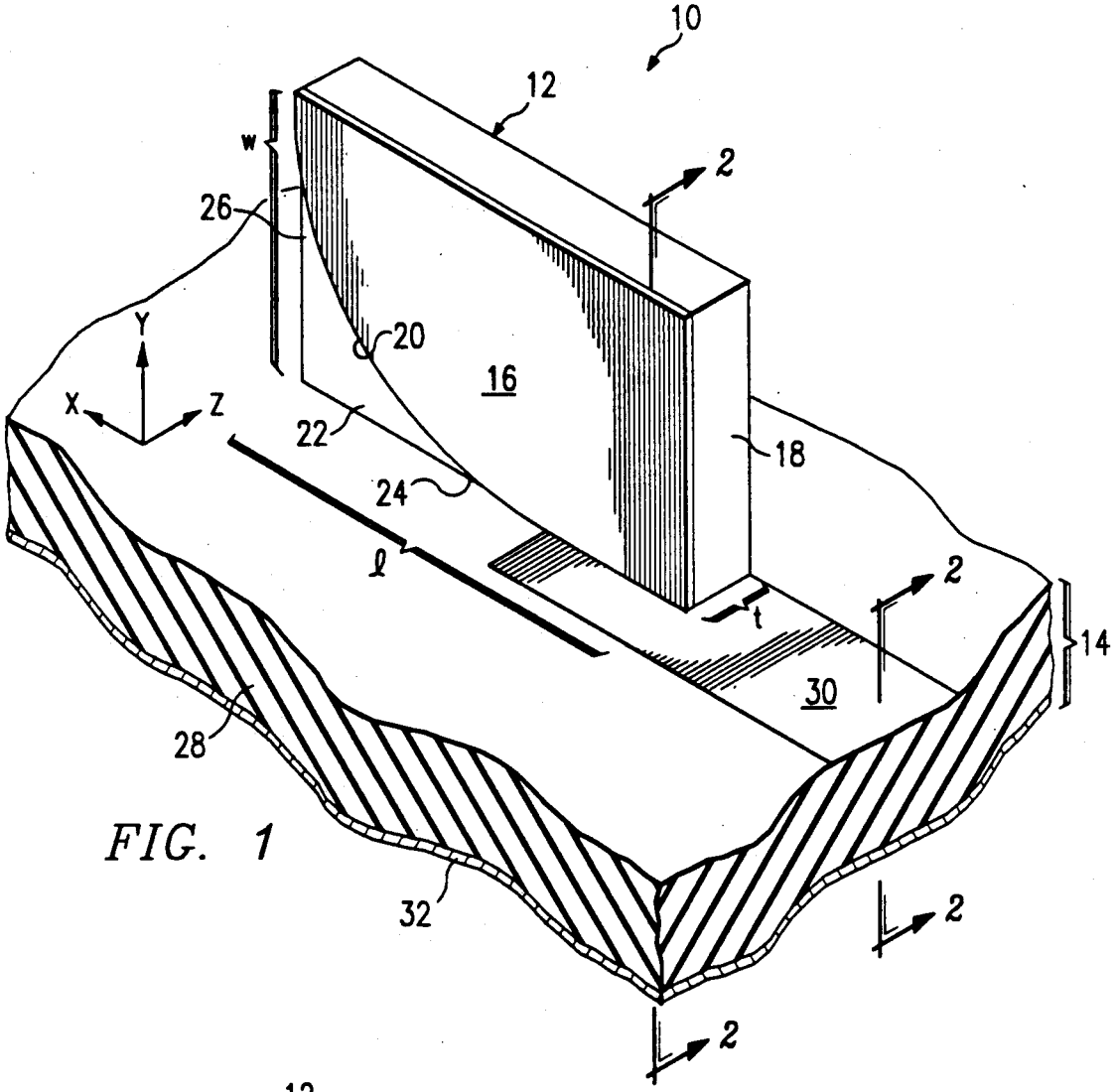
FIG. 1 is a perspective view of a broadband microstrip-fed antenna embodying the present invention.

For purposes of description herein, the terms "upper", "lower", "right", "left", "rear", "front", "vertical", "horizontal", and derivatives thereof shall relate to the invention as oriented in the drawings attached herewith. However, it is to be understood that the invention may assume various alternative orientations, except where expressly specified to the contrary. It is also to be understood that the specific devices illustrated in the attached drawings, and described in the following specification, are simply exemplary embodiments of the inventive concepts defined in the appended claims. Hence, specific dimensions, and other physical characteristics relating to the embodiments disclosed herein are not to be considered as limiting, unless the claims by their language expressly state otherwise.

The reference 10 (FIG. 1) generally designates a broadband, microstrip-fed antenna embodying the present invention. The broadband, microstrip-fed antenna includes an antenna element 12, for receiving and transmitting electromagnetic waves. As shown, antenna element 12 directly contacts a feed assembly 14. In the preferred embodiment, antenna element 12 includes a metallization 16, such as copper, provided on a planar dielectric substrate 18. Suitable dielectric materials for planar substrate 18 may include a ceramic material PTFE composite, fiberglass reinforced with crosslinked polyolefins, alumina and the like. Metallization 16, which has an edge 20, can generally be deposited on a planar substrate 18 by known electrochemical processes, and is relatively thin (e.g., having a thickness of about 0.03 mm or less).

In a preferred embodiment, antenna element 12 is a fabricated from a printed circuit element ("PC card") which is economical to manufacture, light-weight and relatively thin. Moreover, the PC card is easy to position on feed assembly 14 in a reliable way. In the preferred embodiment, broadband, microstrip-fed antenna 10 is designed for satellite applications in which weight considerations and reliable construction is crucial. As will be appreciated by those skilled in the art, the physical characteristics of the PC card make it well suited for use with broadband, microstrip-fed antenna 10. The thickness of a typical PC card used to serve as antenna element 12 in the present invention could generally range within 0.13 mm to 3.0 mm. While in the preferred embodiment antenna element 12 is a PC card, other antenna structures could be used without changing the purposes for which the present invention is intended.

As illustrated in FIG. 1, edge 20 defines a flared slot or notch 22 having a tapered end 24 and a mouth 26. In the present example, edge 20 is exponentially tapered from tapered end 24 to mouth 26. As explained in further detail below, such tapering advantageously contributes to the narrowing of the resultant beamwidth for optimal performance of the antenna 10 in satellite applications and the like.

Antenna element 12 is positioned on and affixed orthogonally to feed assembly 14, i.e. the support structure of antenna element 12. In one example, feed assembly 14 includes a base dielectric 28, which has a first surface upon which a microstrip feed element 30 is disposed. In the preferred embodiment (FIG. 1), antenna element 12 is positioned on the feed assembly 14 such that a portion of metallization 16 is disposed in direct contact with and overlaps microstrip feed element 30, and notch 22 extends away from microstrip feed element 30. Consequently direct signal transmission is achieved between antenna element 12 and microstrip feed element 30.

A ground plane 32 is disposed along a second surface of base dielectric 28 which is separate from and substantially parallel to the first surface of base dielectric 28. In the preferred embodiment, the ground plane 32 is a continuous planar layer of conductive material underlying substantially all of notch 22 and microstrip feed element 30. It should be appreciated that the continuity of ground plate 32, in relation to the microstrip feed element 30 and notch 22, serves to maximize bandwidth and ensure that a desirable level of VSWR is maintained. More particularly, due to the orientation of notch 22 and microstrip feed element 30 with respect to ground plane 32, degradation caused by the "twisting", "bending" of or other discontinuities affecting the E-field is avoided.

In the preferred embodiment, antenna element 12 and microstrip feed element 30 are positioned along a common axis which, in the present example, is an axis parallel to the x-axis shown in FIG. 1. In addition to antenna array layout advantages, this arrangement also optimizes operation. That is, by positioning antenna element 12 and microstrip feed element 30 along a common axis, as in the present example, discontinuities in the E-field tending to degrade broadband performance are minimized.

Figure 2:
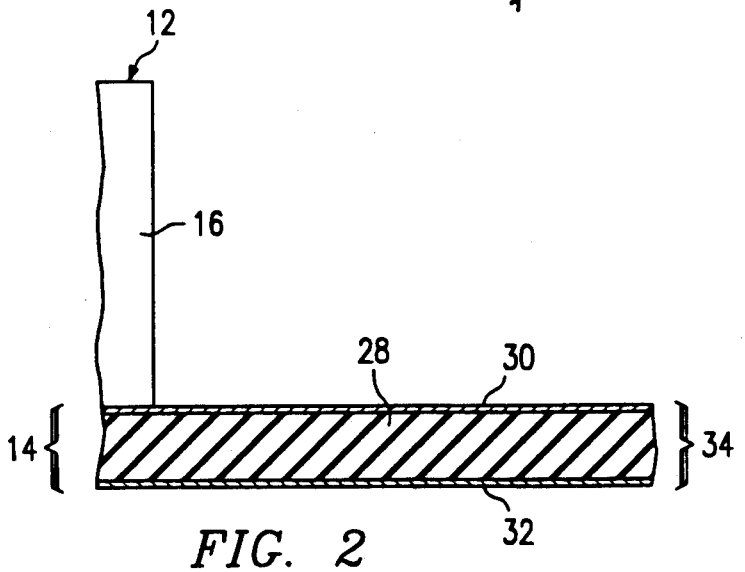
FIG. 2 is a cross-sectional side view of a portion of the disclosed antenna lying in plane 2—2 of FIG. 1.

As illustrated in FIG. 2, ground plane 32 cooperates with base dielectric 28 and microstrip feed element 30 to form a wave guiding structure 34 from which antenna element 12 is fed. The thickness of wave guiding structure 34 could approximately range from 0.13 mm to 2.54 mm. Considering the dimensions of antenna element 12 and wave guiding structure 34, along with the materials from which each is constructed, broadband microstrip-fed antenna 10 is particularly compact and space efficient as well as lightweight. At the same time, the overall design of broadband microstrip-fed antenna 10 is simple, thus facilitating efficient and economical manufacturing of the same.

In the present arrangement, microstrip feed element 30 is directly connected to metallization 16 to alleviate impedance matching, feed-oriented concerns. As should be appreciated, such an arrangement further serves to maximize bandwidth and ensure that a desirable level of VSWR is realized. In the preferred embodiment, the bandwidth range of 2–18 GHZ with a VSWR of 2:1 can be achieved.

The broadband microstrip-fed antenna 10 can be employed in applications requiring narrow beamwidth, such as satellite radar systems. Beamwidths for broadband microstrip-fed antenna 10 can be generally maintained in a range of 40½° to 70½° in the E-plane, and 11½° to 30¼° in the H-plane. To achieve these such beamwidths, flared notch 22 is configured to correspond with a "Vivaldi horn radiator" that has been bisected along its longitudinal axis. With respect to the Vivaldi horn configuration, at least two significant structural details are noteworthy. First, edge 20 is exponentially tapered in accordance with the expression:

$$y^2 = ke^{mx} + c$$

where x is a longitudinal coordinate and y is a transverse coordinate, corresponding to the x and y axes defined in FIG. 1, respectively; c depends on the impedance of the feeding portion of the notch 22; and k and m are constants depending on the length of edge 20 and the dielectric constant of substrate 18, respectively.

Second, referring to FIG. 1, such parameters as the length of notch 22 taken along the x-axis ("l"), the height of mouth 26 taken along the y-axis ("w") and the thickness of base dielectric taken along the z-axis ("t") have a significant impact on beamwidth. More specifically, when the values of l and w are, at center frequency, within ranges of about 4λ to 6λ and 2λ to 5λ, respectively, the above-specified beamwidth range can be realized. As should be appreciated, other ranges of values of l and w could be used to achieve the above-noted specification range for beamwidth without changing the purpose for which the present invention is intended.

In one example of operation, broadband microstripfed antenna 10 is fed by microstrip feedline 30 and, when supplied with r.f. signals, broadband microstripfed antenna 10 creates a field across notch 22 which thereby establishes the propagation of the field of radiation. It will be appreciated that the polarization of broadband microstrip-fed antenna 10 is somewhat analogous to that of a simple dipole antenna in that radiation is launched linearly from the flared notch 22 with the E-vector component centered about a plane parallel to the plane of the planar substrate 18 and the H-vector component centered about a plane normal thereto.

As will be apparent to those skilled in the art, the subject invention is apt for array structure applications, in particular, phased-array arrangements. In one example, a plurality of broadband microstrip-fed antennas 10 could be mounted on a support structure with interconnected amplifiers and phase shifters capable of coordinated performance. As is conventional with phased-array antennas, the individual antenna elements are electrically switched and selectively excited such that a combined electromagnetic field, having an overall gain greater than that of an individual antenna of the array, is achieved.

As should be appreciated, the simple, yet efficient design of broadband microstrip-fed antenna 10 makes it particularly well suited for use in arrays. For example, some antenna array layout advantages achieved through use of broadband microstrip-fed antennas 10 would include:

compactness;
inexpensive construction;
good matching over the desired band; and
reliability.

In the foregoing description, it will be readily appreciated by those skilled in the art that modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. A broadband antenna, comprising:
a first substrate;
microstrip feed element being disposed along a first surface of said first substrate;
notch antenna means comprising a second substrate and a metalization portion thereupon, said notch antenna means being positioned orthogonal to said first surface of said first substrate with said metalization portion in direct physical and electrical contact with said microstrip feed element for direct signal transmission therebetween; and
ground means being disposed along a second surface of said first substrate in a substantially opposing relationship to said microstrip feed element and being positioned to provide a ground for said notch antenna means,
wherein said broadband antenna generates an E-field in a plane orthogonal to said first substrate and propagating from the end of said notch antenna means.

2. The antenna of claim 1, wherein said second substrate includes:
a material selected from one of: polytetrafluoroethylene, fiberglass and alumina.

3. The antenna of claim 1, wherein:
said metalization portion has a tapered edge extending laterally away from said microstrip feed element, and said tapered edge cooperates with said first substrate to define a flared notch.

4. The antenna of claim 3, wherein:
said tapered edge flares outwardly according to a continuous exponential function.

5. The antenna of claim 4, wherein said continuous exponential function is defined by the equation:

$$y^2 = ke^{mx} + c$$

wherein,
X is a longitudinal coordinate and y is a transverse coordinate corresponding to respective axes, and
k=a constant related to the length of said tapered edge,
m=the dielectric constant of said second substrate, and
c=a constant which varies as a function of the impedance of a feeding portion of said flared notch.

6. The antenna of claim 3, wherein:
said tapered edge flares outwardly according to a continuous linear function.

7. The antenna of claim 3, wherein the length of said flared notch, measured along an axis substantially colinear with said tapered edge, is in a range of about 4λ to 6λ, at center frequency.

8. The antenna of claim 3, wherein said flared notch has a mouth portion that is substantially transverse to said tapered edge, and wherein the height of said mount portion is in a range of about 2λ to 5λ, at center frequency.

9. The antenna of claim 1, wherein said notch antenna means is a printed circuit card having a thickness of between 0.13 mm and 3.0 mm.

10. The antenna of claim 1, wherein said microstrip feed element and said notch antenna means are positioned about a common longitudinal center axis.

11. The antenna of claim 1, wherein
said notch antenna means and said microstrip feed element are positioned along a common axis.

12. The antenna of claim 1, wherein:
said notch antenna means and said microstrip feed element are positioned along a common first axis and wherein said ground means is positioned along a second axis which is substantially parallel to said first axis.

13. A broadband antenna comprising:
a first substrate;
microstrip conducting means being disposed on a first surface of said first substrate;
ground plane means being disposed on a second surface of said first substrate, said second surface being in substantially opposing relation to and spaced from said first surface; and,
antenna means being positioned orthogonal to said first surface of said first substrate and comprising:
a second substrate;
a metallization being disposed on a surface of said second substrate, a portion of said metallization being in substantially direct physical contact with a portion of said microstrip conducting means for directly transmitting signals therebetween, said metallization having a tapered edge extending laterally away from said microstrip conducting means, said tapered edge and said first substrate defining a flared notch, and said tapered edge flaring outwardly according to a continuous exponential function.

* * * * *